US009627826B2

(12) United States Patent
Wu et al.

(10) Patent No.: US 9,627,826 B2
(45) Date of Patent: Apr. 18, 2017

(54) POWER CONNECTOR ASSEMBLY WITH CONTACTS CONVENIENTLY SOLDERED TO CABLE WIRES

(71) Applicant: FOXCONN INTERCONNECT TECHNOLOGY LIMITED, Grand Cayman (KY)

(72) Inventors: Jerry Wu, Irvine, CA (US); Jun Chen, Kunshan (CN); Fan-Bo Meng, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/941,312

(22) Filed: Nov. 13, 2015

(65) Prior Publication Data

US 2016/0141817 A1 May 19, 2016

(30) Foreign Application Priority Data

Nov. 14, 2014 (CN) ..... 2014 2 0677008 U

(51) Int. Cl.
*H01R 24/00* (2011.01)
*H01R 24/60* (2011.01)
(Continued)

(52) U.S. Cl.
CPC ..... *H01R 24/60* (2013.01); *H01R 4/023* (2013.01); *H01R 13/405* (2013.01); *H01R 24/30* (2013.01); *H01R 31/08* (2013.01)

(58) Field of Classification Search
CPC ..... H01R 13/658; H01R 13/6585; H01R 13/6586; H01R 23/02; H01R 24/60; H01R 24/62
(Continued)

(56) References Cited

U.S. PATENT DOCUMENTS 9,033,738 B2 * 5/2015 Wang ..... H01R 13/6471 439/607.08
2011/0143600 A1 * 6/2011 Kuo ..... H01R 4/023 439/660
(Continued)

FOREIGN PATENT DOCUMENTS

TW M264690 5/2005

*Primary Examiner* — Hae Moon Hyeon
(74) *Attorney, Agent, or Firm* — Wei Te Chung; Ming Chieh Chang

(57) ABSTRACT

A power connector assembly (100) includes a cable (7) including a number of wires (70), an insulative housing (1), and a number of electrical contacts (2). The electrical contacts include at least one detection contact (22) and plural contacts (21). Each of the plural contacts includes a pair of mating portions (211), a pair of middle portions (212) extending rearwardly from the mating portions respectively, a connecting portion (213) connected with the middle portions, and a first soldering portion (214) connected with the connecting portion. The at least one detection contact includes a second soldering portion (223). Each of the first soldering portions and the second soldering portion includes a soldering area soldered to respective one of the wires, and all of the soldering areas are disposed at a common horizontal plane, arranged in a straight line, and soldered to corresponding wires at same time.

21 Claims, 5 Drawing Sheets

(51) Int. Cl.

| | |
|---|---|
| *H01R 13/405* | (2006.01) |
| *H01R 4/02* | (2006.01) |
| *H01R 24/30* | (2011.01) |
| *H01R 31/08* | (2006.01) |

(58) Field of Classification Search
USPC ..... 439/676, 660, 607.05, 607.55, 856, 857, 439/607.01
See application file for complete search history.

(56) References Cited

U.S. PATENT DOCUMENTS

| | | | | |
|---|---|---|---|---|
| 2013/0115823 | A1* | 5/2013 | Wu | H01R 13/6471 439/660 |
| 2013/0130548 | A1* | 5/2013 | Wu | H01R 13/6598 439/607.01 |
| 2013/0323970 | A1* | 12/2013 | Wang | H01R 13/6471 439/607.08 |
| 2014/0335729 | A1* | 11/2014 | Little | H01R 24/60 439/607.53 |

* cited by examiner

POWER CONNECTOR ASSEMBLY WITH CONTACTS CONVENIENTLY SOLDERED TO CABLE WIRES

BACKGROUND OF THE INVENTION

1. Field of the Invention

The present invention relates to a power connector assembly, and more particularly to soldering structure of contacts thereof 2. Description of Related Arts Taiwan Patent No. M264690, issued on May 11, 2005 to Lai et al., discloses an electrical connector soldered with wires of a cable. The electrical connector comprises an insulative housing and a plurality of contacts received in the insulative housing. Each of the contacts comprises a pair of mating portions disposed face to face and spaced apart from each other along a vertical direction and a soldering portion connected with the two mating portions.

SUMMARY OF THE INVENTION

An object of the present invention is to provide a power connector assembly with contacts conveniently soldered to cable wires.

To achieve the above-mentioned object, a power connector assembly comprises: a cable comprising a plurality of wires; an insulative housing; and a plurality of electrical contacts received in the insulative housing, the electrical contacts comprising at least one detection contact and a plurality of contacts, each of the plurality of contacts comprising a pair of mating portions disposed face to face and spaced apart from each other along a vertical direction, a pair of middle portions extending rearwardly from the mating portions respectively, a connecting portion connected with the pair of middle portions, and a first soldering portion connected with a rear side of the connecting portion, the at least one detection contact comprising a second soldering portion; wherein each of the first soldering portions and the second soldering portion comprises a soldering area soldered to a respective one of the wires, and all of the soldering areas are disposed at a common horizontal plane, arranged in a straight line, and soldered to corresponding wires at same time.

According to the present invention, direct soldering with the soldering areas at same time without use of a printed circuit board simplifies manufacturing process and reduces cost.

DETAILED DESCRIPTION OF THE PREFERRED EMBODIMENT

Figure 1:
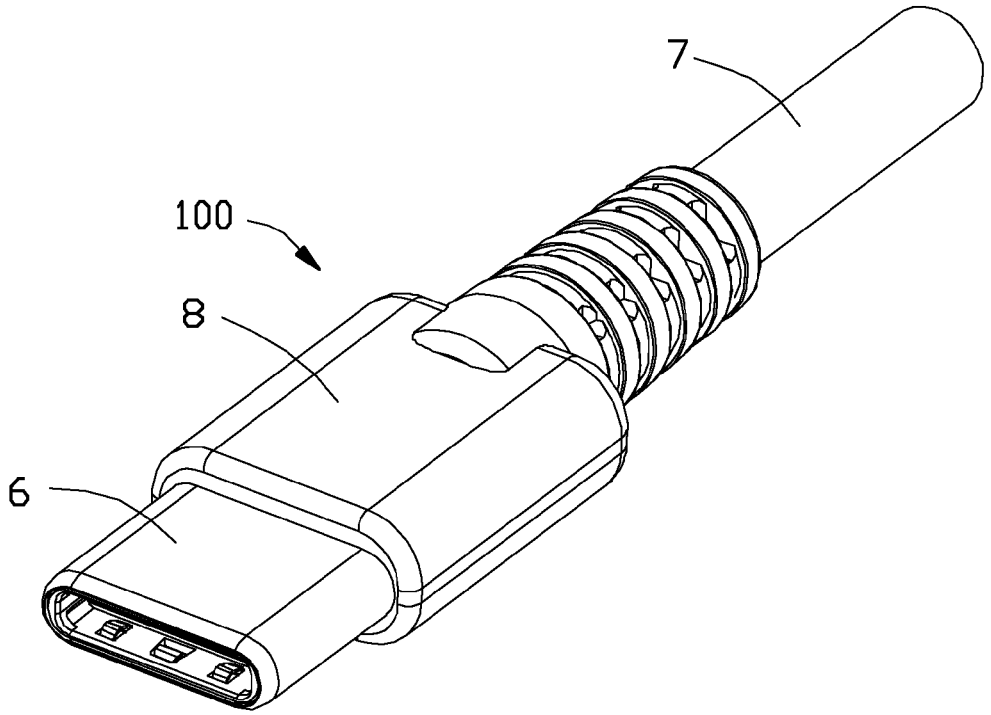
FIG. 1 is a perspective view of a power connector assembly in accordance with the present invention.
Figure 2:
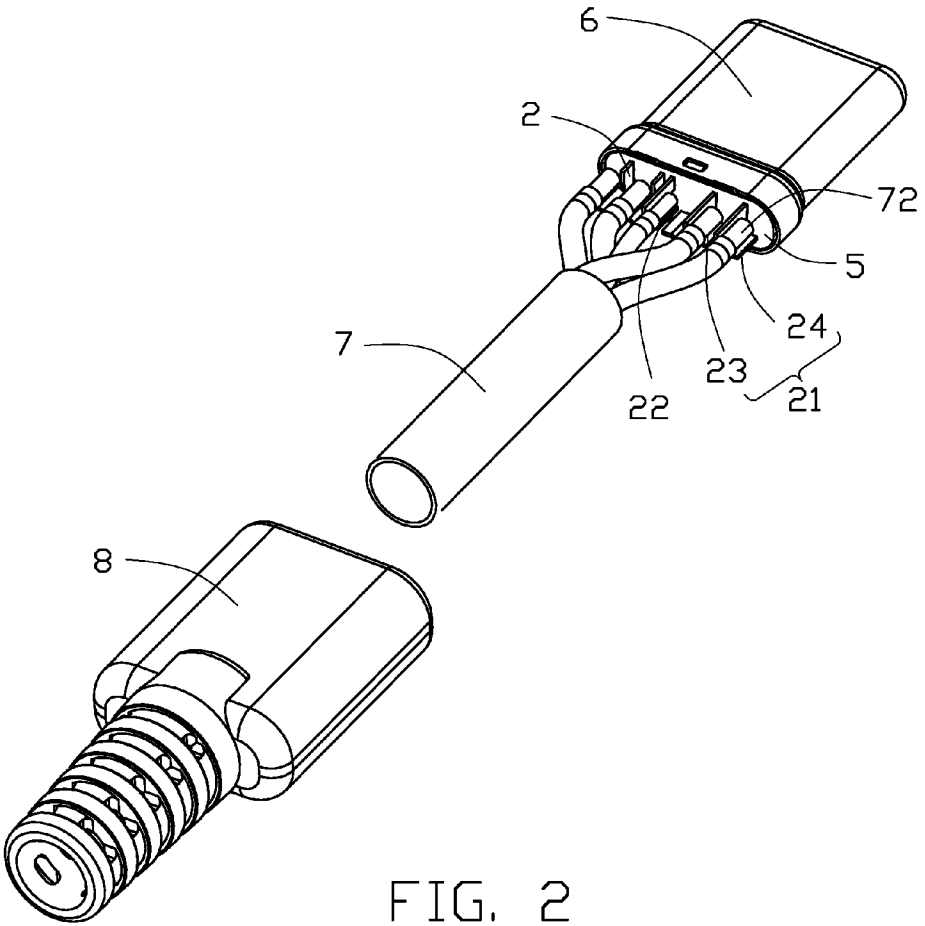
FIG. 2 is a partly exploded view of the power connector assembly as shown in FIG. 1.

Reference will now be made in detail to a preferred embodiment of the present invention.

Referring to FIGS. 1 to 5, a power connector assembly 100 adapted for mating with a mating connector comprises an insulative housing 1, a plurality of contacts 2 received in and fixed in the insulative housing 1, a pair of grounding members 3 mounted on the insulative housing 1, a latch member 4 received in the insulative housing 1 for being latched with the mating connector, a spacer 5 disposed at a rear side of the insulative housing 1 to arrange the contacts, a mating shell 6 enclosing the insulative housing 1 an the spacer 5, a cable 7 comprising a plurality of wires 70 directly soldered with the contacts 2 respectively, and an outer shell 8 enclosing a portion of the mating shell 6. The power connector assembly 100 can be mated with the mating connector in two reversed orientations to perform same function.

The insulative housing 1 comprises a top wall 11, a bottom wall 12 spaced apart from and parallel to the top wall 11, a pair of side walls 13 spaced apart from and parallel to each other and connected with the top wall 11 and the bottom wall 12, and a receiving room or mating cavity 14 surround by the top wall 11, the bottom wall 12, and the pair of the side wall 13 to forwardly communicate with an exterior in a front-to-back direction Y. The receiving room 14 is divided into a first portion 142 having a front opening 141 opening forwardly and a second portion 144 having a rear opening 143 opening rearwardly. The top wall 11 defines a top recess 111 disposed at a front portion thereof and in communication with the first portion 142 of the receiving room 14. The bottom wall 12 defines a bottom recess 121 disposed at a front portion thereof and in communication with the first portion 142 of the receiving room 14. Each of the side walls 13 defines a slot 131 extending from a rear end of the insulative housing 1 toward but not through a front end of the insulative housing 1. The slots 131 are in communication with the first and the second portions 142, 144. Both of the top and the bottom walls 11, 12 define a plurality of through holes 15 adjacent to a front end of the insulative housing 1 and in communication with the first portion 142. The insulative housing 1 comprises a pair of projection portions 1421 at two side walls 13 and adjacent to the first portion 142 of the receiving room 14.

The electrical contacts 2 comprise a plurality of contacts 21 and a pair of detection contacts 22. Each of the contacts 21 comprises a pair of first mating portions 211 disposed face to face and spaced apart from each other along vertical direction, a pair of first middle portions 212, each with a barb B, extending rearwardly from the first mating portions 211 respectively, a first connecting portion 213 connected with the pair of first middle portions 212, and a first soldering portion 214 connected with a rear side of the connecting portion 213. In another aspect, with the corresponding paired first mating portions 211 and first middle portions 212, and the corresponding first connecting portions 213, the first contacts 21 can be regarded as a plurality of first row contacts arranged in one row along a transverse direction X perpendicular to the front-to-back direction Y and a plurality of second row contacts arranged in the other row along the transverse direction X wherein the first row contacts and the second row contacts are located by two opposite sides of the mating cavity 14, respectively, in a vertical direction Z perpendicular to both the front-to-back direction Y and the transverse direction X. In this viewpoint, the first row contacts and said second row contacts are paired with each other, wherein in most pairs the first row contact and the second row contact in each pair are aligned with each other in the vertical direction and joined together with a common soldering portion 214 at a rear end. Each of the detection contacts 22 comprises a second mating portion 221 for being mated with the mating connector, a second middle portion 222 extending rearwardly from the second mating portion 221, and a second soldering portion 223 connected with a rear side of the second middle portion 222. Each of the first soldering portions 214 comprises a first side wall 215 disposed on a vertical plane, and a first soldering area 216 connected with the first side wall 215 and disposed on a horizontal plane. Notably, both the vertical plane and the horizontal plane commonly form a (right) angled structure and the angled structures of all the first contacts 21 and the second contacts 22 are diagonally symmetrically arranged with regard to a center of the connector 100, viewed along the front-to-back direction. Each of the second soldering portions 223 comprises a second side wall 224 disposed on a vertical plane, and a second soldering area 225 connected with the second side wall 224 and disposed on the horizontal plane. All of the first and the second soldering areas 216, 225 are disposed at a same horizontal plane that can be soldered with respective one of the inner conductors 72 of the wires 70 respectively at same time. Each of the first and the second soldering areas 216, 225 comprise an upper surface 25 and a bottom surface 26. All of the wires 70 are soldered on all of the upper surfaces 25 or the bottom surfaces 26 of the first and the second soldering areas 216, 225 at same time. Each of the first soldering areas 216 is larger than the second soldering area 225. The detection contacts 22 are disposed central symmetry at a middle portion of the insulative housing 1. The pair of the second soldering areas 225 are extending toward each other. Only one of the pair of detection contacts 22 is soldered with the inner inductor 72 of the wire 70 of the cable 7. Noticeably, in the paired detection contacts 22 are not aligned with each other in the vertical direction Z but transversely offset from each other and equipped with respective soldering portions 225. The contacts 21 comprise a pair of power contacts 23 and a pair of grounding contacts 24. The pair of power contacts 23 are disposed central symmetry at outer sides of the detection contacts 22, respectively. The pair of grounding contacts 24 are disposed central symmetry at outer sides of the power contacts 23, respectively. The first soldering areas 216 of the power contacts 23 are extending far away from the detection contacts 22 respectively to prevent the wires 70 incorrectly soldered with the second soldering areas 225 of the detection contacts 22. The first soldering areas 216 of the grounding contacts 24 are extending far away from the power contacts 23 respectively to prevent the wires 70 incorrectly soldered with the first soldering areas 216 of the power contacts 23.

The pair of grounding members 3 are mounted on the top and the bottom walls 11, 12 of the insulative housing 1, respectively. Each of the grounding members 3 comprises a body portion 31, a pair of elastic mounting members 32 extending from two ends of the body portion 3 and agley toward the insulative housing 1 respectively, and a plurality of elastic grounding tabs 33 extending from the body portion 31 forwardly and into the first portion 142 of the receiving room 14 through the through holes 15 respectively for being mated with the mating connector to establish grounding connection. Each of the elastic mounting members 32 defines a through hole 321 to be latched with the projection portion 1421 of the insulative housing 1.

The latch member 4 comprises a base portion 41 extending transversely, a pair of latching beams 42 extending forwardly from two ends of the base portion 41, and a pair of latching portions or hooks 43 extending from free ends of the latching beams 42 respectively and toward each other. The latch member 4 is assembled to the insulative housing 1 through the rear opening 143 of the second portion 144 along a rear to front direction. The pair of latching beams are received in the slots 131 respectively, and at least a portion of the latching portions 43 are projected into the first portion 142 of the receiving room 14.

Figure 3:
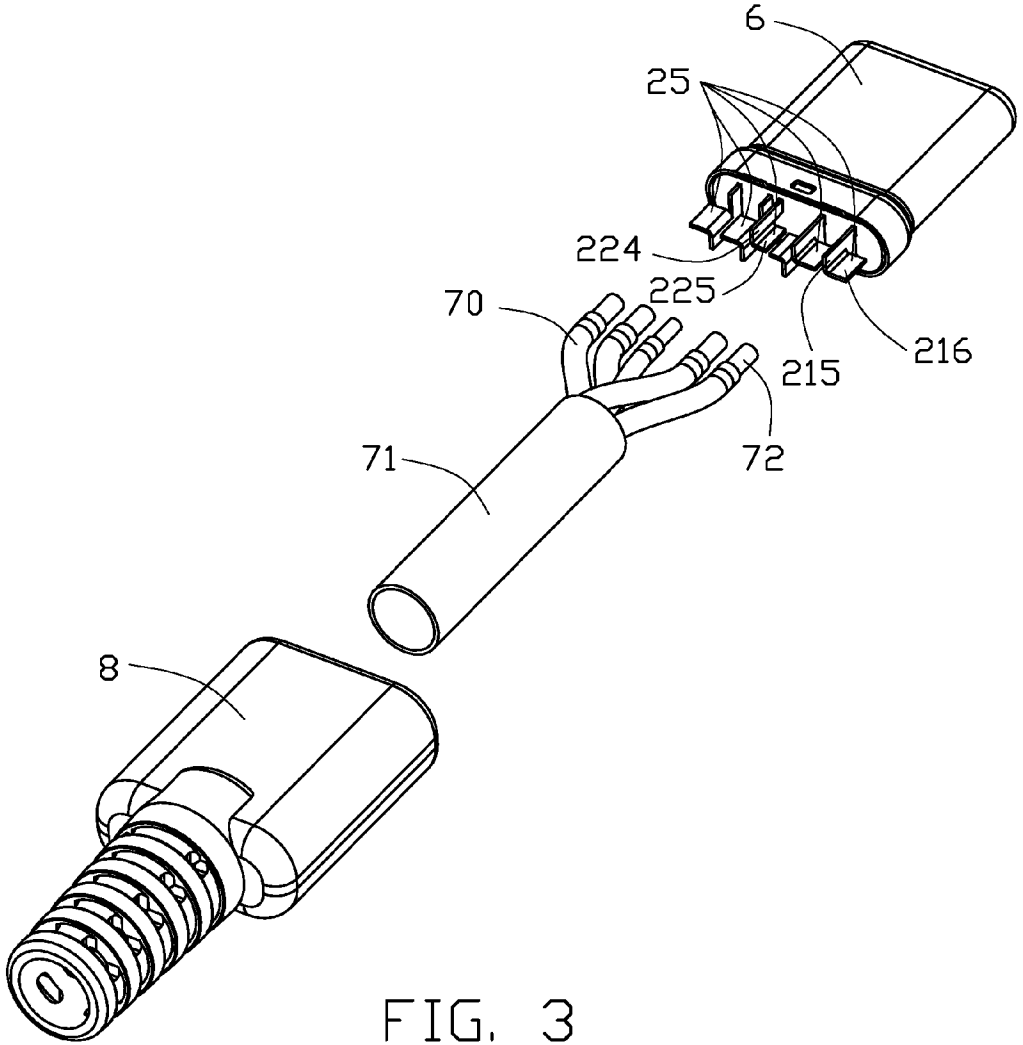
FIG. 3 is further partly exploded view of the power connector assembly as shown in FIG. 2.
Figure 4:
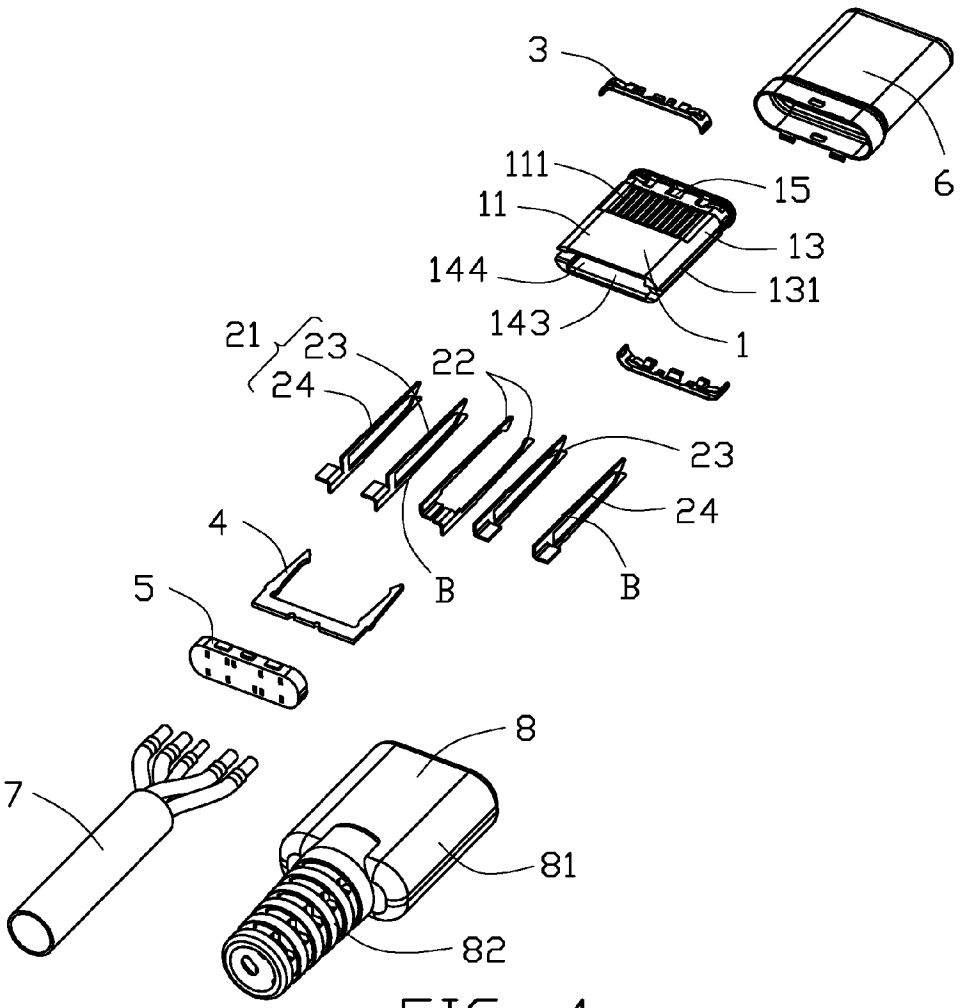
FIG. 4 is an exploded view of the power connector assembly as shown in FIG. 1.
Figure 5:
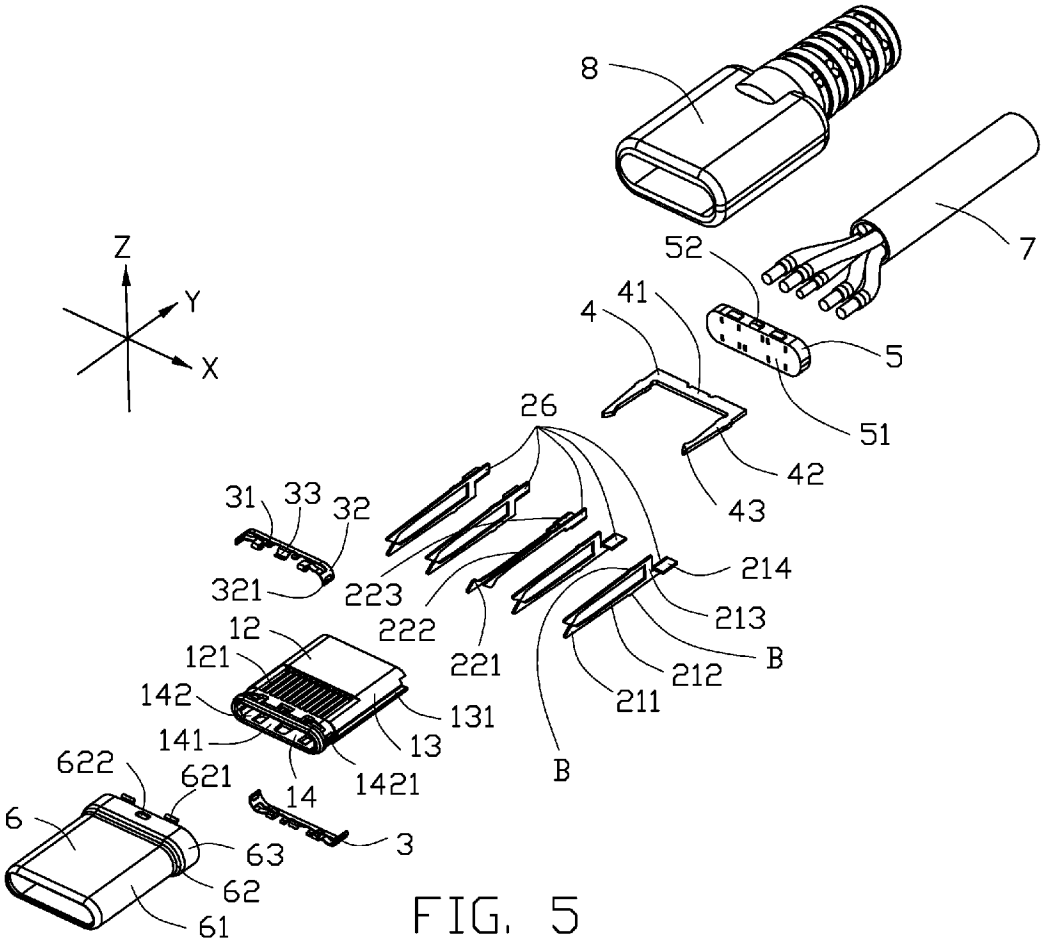
FIG. 5 is another exploded view of the power connector assembly as shown in FIG. 4.

The spacer 5 defines a plurality of contacts holes 51 to fix and arrange the electrical contacts 2. Referring to FIGS. 3-5, notably the first connecting portions 213 are embedded within the spacer 5, the first soldering portions 214 are exposed behind the spacer 5, and the paired first middle portions 212 and first mating portions 211 are exposed in front of the spacer 4. The spacer 5 comprises a plurality of tabs 52. The mating shell 6 has a closed circumference surface that has a good seal performance and good anti-EMI performance. The mating shell 6 can be formed by the methods of metal sheet pumping process, metal strip bending process, or metal material casting process, etc. The mating shell 6 comprises a front portion 61 for being inserted into the mating connector, a rear portion 62 larger than the front portion 61, and a transition portion 63 connected with the front portion 61 and the rear portion 62. The rear portion 62 comprises a plurality of latch tabs 621 extending rearwardly and outwardly. The rear portion 62 defines a plurality of latching holes 622 latched with the tabs 52 of the spacer 5, respectively. The cable 7 comprises a jacket 71 enclosing the wires 70. The outer shell 8 comprises main portion 81 enclosing a portion of the mating shell 6 and a portion of the cable 7, and a strain release portion 82 extending rearwardly from the main portion 81 and enclosing the cable 7.

The steps of assembling the power connector assembly 100 comprise: firstly, molding the spacer 5 in the electrical contacts 2, mounting the electrical contacts 2 with the spacer, and the latch member 4 in the insulative housing 1, mounting the grounding members 3 on the top wall Hand the bottom wall 12, respectively; then, assembling the insulative housing 1 into the mating shell 6 with the first soldering portion 214 and the second soldering portion 223 exposed out of the mating shell 6, putting the wires 70 of the cable 7 alignment with the first soldering portion 214 and the second soldering portion 223 respectively and then soldering the wires and the first soldering portion 214 and the second soldering portion 223 at same time; and, finally, overmolding the outer shell 8 on a portion of the mating shell 6 and a portion of the cable 7, or mounting the outer shell 8 on the mating shell 6 and the cable 7 and fixing them by glues.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A power connector assembly comprising:

a cable comprising a plurality of wires;

an insulative housing; and a plurality of electrical contacts received in the insulative housing, the plurality of electrical contacts comprising at least one detection contact and a plurality of contacts, each of the plurality of contacts comprising a pair of mating portions disposed face to face and spaced apart from each other along a vertical direction, a pair of middle portions extending rearwardly from the mating portions respectively, a connecting portion connected with the pair of middle portions, and a first soldering portion connected with a rear side of the connecting portion, the at least one detection contact comprising a second soldering portion;

wherein each of the first soldering portions and the second soldering portion comprises a soldering area soldered to a respective one of the wires, and all of the soldering areas are disposed at a common horizontal plane, arranged in a straight line, and soldered to corresponding wires at same time.

2. The power connector assembly as recited in claim 1, wherein all of the wires are soldered on a same side of the common horizontal plane.

3. The power connector assembly as recited in claim 2, wherein each of the first soldering portions comprises a vertical side wall connected with a corresponding soldering area.

4. The power connector assembly as recited in claim 3, wherein the second soldering portion of the at least one detection contact comprises a vertical side wall.

5. The power connector assembly as recited in claim 4, wherein each of the soldering areas of the first soldering portions is larger than the soldering area of the second soldering portion.

6. The power connector assembly as recited in claim 5, wherein there are a pair of detection contacts disposed central symmetry at a middle portion of the insulative housing.

7. The power connector assembly as recited in claim 6, wherein the two soldering areas of the pair of detection contacts extend toward each other.

8. The power connector assembly as recited in claim 6, wherein only one of the pair of detection contacts is soldered with the wire of the cable.

9. The power connector assembly as recited in claim 8, wherein the plurality of contacts comprise a pair of power contacts and a pair of grounding contacts, the pair of power contacts disposed central symmetry at outer sides of the detection contacts respectively, the pair of grounding contacts disposed central symmetry at outer sides of the power contacts respectively.

10. The power connector assembly as recited in claim 9, wherein the soldering areas of the power contacts extend in a direction away from the detection contacts, respectively.

11. A power connector assembly comprising:

an insulative housing defining a mating cavity forwardly communicating with an exterior along a front-to-back direction;

a plurality of first row contacts arrange in one row along a transverse direction perpendicular to said front-to-back direction;

a plurality of second row contacts arranged in another row along the transverse direction;

said first row contacts and said second row contacts being located by two opposite sides of the mating cavity, respectively, in a vertical direction perpendicular to both said front-to-back direction and said transverse direction, said first row contacts and said second row contacts being paired with each other, in most pairs the first row contact and the second row contact in each pair being aligned with each other in the vertical direction and joined together with a common soldering portion at a rear end; and at least one pair in which the first row contact and the second row contact are not aligned with each other in the vertical direction, having the paired first row contact and second row contact spaced from each other in the transverse direction without sharing the same commonly soldering portion; wherein all the soldering portions of both the vertically aligned paired first contacts and second contacts, and the transversely offset first contact and second contact, are exposed to an exterior in a same vertical direction so as to allow respectively soldering corresponding wires upon said all the soldering portions at the same time.

12. The power connector assembly as claimed in claim 11, wherein the commonly soldering portion defines an angled structure while all angle structures are diagonally symmetrically arranged with regard to a center of the connector, viewed in the front-to-back direction.

13. A power connector assembly comprising:

an insulative housing defining a mating cavity forwardly communicating with an exterior along a front-to-back direction;

a plurality of first row contacts arrange in one row along a transverse direction perpendicular to said front-to-back direction;

a plurality of second row contacts arranged in another row along the transverse direction;

said first row contacts and said second row contacts being located by two opposite sides of the mating cavity, respectively, in a vertical direction perpendicular to both said front-to-back direction and said transverse direction, said first row contacts and said second row contacts being paired with each other, in most pairs the first row contact and the second row contact in each pair being aligned with each other in the vertical direction and joined together with a common soldering portion at a rear end; wherein the commonly soldering portion defines an angled structure while all angled structures are diagonally symmetrically arranged with regard to a center of the connector, viewed in the front-to-back direction; wherein all the angled structure provide soldering faces directing to a same vertical direction for having corresponding wires soldered thereon simultaneously.

14. The power connector assembly as claimed in claim 13, wherein the angled structures are arranged in opposite first and second rows each along said transverse direction, and the angled structures in the first row and those in the second row are orientated in opposite manner with each other.

15. A power connector assembly, comprising;

an insulative housing defining a receiving room opening forwardly;

a power contact and a grounding contact, each of said power contact and said grounding contact comprising a pair of first mating portions extending forwards and located by two opposite sides of the receiving room respectively, and joined together with a common first soldering portion at a rear end;

at least one detecting contact comprising a second mating portion extending forwards and located at only one side of the receiving room without any other second mating portion at the other side of the receiving room, and a second soldering portion at a rear end thereof; and a metallic latch member comprising a pair of latching beams extending forward, with latching hooks at front ends of the latching beams and towards each other into the receiving room;

wherein each pair of first mating portions are aligned with each other in a vertical direction, and the first soldering portions of the power contact and the grounding contact provide soldering areas directing to a same wherein all the first and second soldering portions are located behind the latching beams of the metallic latch member.

16. The power connector assembly as claimed in claim 15, wherein all the first soldering portions and the second soldering portion provide upper soldering areas so as to allow respectively soldering corresponding wires of a cable upon all the soldering portions at a same time.

17. The power connector assembly as claimed in claim 15, further including an insulative spacer located behind the insulating housing and integrally formed with all contacts.

18. The power connector assembly as claimed in claim 17, wherein said latch member is located in front of the spacer, and the first and second soldering portions are located behind the spacer.

19. The power connector assembly as claimed in claim 15, wherein each of each pair of first mating portions has corresponding barbs at rear end thereof for retaining to the insulating housing.

20. The power connector assembly as claimed in claim 15, wherein all the contacts extend in the vertical direction except the first and second soldering portions extending in a transverse direction.

21. The power connector assembly as claimed in claim 15, wherein each pair of first mating portions are joined with each other via a first connecting section located in front of the corresponding first soldering portion, and the latch member includes a transverse base connecting to said pair of latch beams and located in front of said first connecting section.

* * * * *